US007045725B2

(12) United States Patent
Gallagher et al.

(10) Patent No.: US 7,045,725 B2
(45) Date of Patent: May 16, 2006

(54) SAFETY SENSOR FOR POWER OPERATED OVERHEAD DOOR

(75) Inventors: Mark Gallagher, Holland, PA (US); Robert J. Doughty, Bensalem, PA (US)

(73) Assignee: Abstract Overhead Door Co., Inc., Croydon, PA (US)

( * ) Notice: Subject to any disclaimer, the term of this patent is extended or adjusted under 35 U.S.C. 154(b) by 183 days.

(21) Appl. No.: 10/804,242

(22) Filed: Mar. 18, 2004

(65) Prior Publication Data

US 2004/0187406 A1 Sep. 30, 2004

Related U.S. Application Data

(63) Continuation of application No. 60/457,639, filed on Mar. 25, 2003.

(51) Int. Cl.
*H01H 35/02* (2006.01)

(52) U.S. Cl. ..... 200/61.52; 200/61.45 R

(58) Field of Classification Search ..... 200/61.52, 200/61.45 R, 61.46, 52 A
See application file for complete search history.

(56) References Cited

U.S. PATENT DOCUMENTS

| | | | | |
|---|---|---|---|---|
| 2,791,654 A | | 5/1957 | Nikazy | |
| 3,001,038 A | | 9/1961 | Gessell | |
| 3,855,733 A | | 12/1974 | Miller | |
| 4,115,952 A | | 9/1978 | French | |
| 4,953,608 A | | 9/1990 | Larsson | |
| 5,202,559 A | * | 4/1993 | Durst | 250/231.1 |
| 5,672,856 A | * | 9/1997 | Kolb et al. | 200/61.52 |
| 5,808,254 A | * | 9/1998 | Wu | 200/61.45 R |
| 5,894,267 A | * | 4/1999 | Blair | 340/545.1 |
| 6,075,333 A | | 6/2000 | Huddle | |
| 6,198,059 B1 | * | 3/2001 | Jou | 200/61.52 |
| 6,246,176 B1 | * | 6/2001 | Fai | 315/119 |

* cited by examiner

*Primary Examiner*—K. Lee
(74) *Attorney, Agent, or Firm*—Anthony J. Casella; Gerald E. Hespos

(57) ABSTRACT

A safety sensor for a power operated overhead door includes an elongated housing having an elongated pathway which is a circular in cross sections along its length, with the greatest diameter of the pathway being at it midpoint. Form the midpoint, the pathway tapers downwardly in opposite directions, with a recess portion at each opposite end. In each recess portion there are two spaced electrical contacts. A ball bearing is disposed in the elongated pathway. The sensor is mounted horizontally to an overhead door, and if the door is tilted from the horizontal, the ball bearing rolls to the lower recess area, thereby establishing electrical contact which operates to stop the movement of the door. The obstruction to the door is then cleared, and the system is reset.

10 Claims, 4 Drawing Sheets

SAFETY SENSOR FOR POWER OPERATED OVERHEAD DOOR

This application claims priority based upon U.S. Provisional Application Ser. No. 60/457,639 filed on Mar. 25, 2003, which is incorporated herein by reference.

BACKGROUND OF THE INVENTION

1. Field of the Invention

The subject invention generally relates to a new and improved sensor for use as part of a safety system that is incorporated in a motor operated upwardly acting door. In particular, the safety system of the subject invention is used in upwardly acting doors that are in commercial and industrial applications.

Upwardly acting doors fall into three basic categories. First, there are sectional type upwardly acting doors that are generally constructed of various metals, woods and synthetic materials and comprise a plurality of individual sections which are fixed by mechanical hinge means to form a complete door of a size required for the given industrial or commercial application. The hinges extend along the longitudinal axis of each individual section and, at the end of each section, guide wheels are provided to allow the sections to follow along a pair of guide tracks to allow the door to move upwardly and downwardly to open and closed positions in a predetermined path. Usually, the door is in a vertical position when closed, and in a generally horizontal position when open.

Another form of an upwardly acting door is a one-piece door structure that is manufactured from various materials including wood, metal and synthetic materials. As the name implies, the entire door is produced to form a single panel, and numerous different designs exist to provide counterbalance and path guidance as the one-piece door is moved from the closed, generally vertical position, to the open, generally horizontal position. The one-piece door moves from the closed position to the horizontal open position by pivoting of the panel from the vertical plane and, at the same time, retracting it along the horizontal plane, thereby achieving the open position, at which point the door is generally horizontal.

Another common form of commercial or industrial upwardly acting door is generally referred to as a rolling steel door. Rolling steel doors are generally manufactured from various metals and consist of individual slats which are generally manufactured by roll forming to produce a desired shape. The slats are assembled by sliding one slat into another slat along a longitudinal axis to thereby form a curtain until the required door height is achieved, at which point a device is fixed to the end of the slats to prevent lateral movement thereof. The completed rolling steel door or curtain is then attached to a counterbalance assembly which applies the required forces to move the curtain in a vertical direction. As the rolling steel door or curtain is moved in a vertical direction, it is rolled about itself and stored around the counterbalance assembly to form a cylindrical shape. Usually, the counterbalance assembly has an outer cylindrical casing into which the rolled steel door or curtain is stored when the door is in the open position to allow access to the commercial or industrial building.

For each of the above-mentioned upwardly acting doors, it is well known to provide automated operation through the use of various mechanical means which are powered by either electric motors, hydraulic cylinders or pneumatic cylinders. All of the known automated systems employ an electrical or electronic control system to control the movement of the door as it travels between the open and closed positions.

In existing motor-operated door systems, usually a motor is electrically powered and turns a drum to either retract all of the panels into the storage container of the roll-up door when opening the door, or spool out the panels when the door is being actuated to its closed position. As part of the typical control circuit for an automatically opening door, it is usual to provide a sensing device which, upon encountering an obstruction in the door's path, automatically shuts off the electrical system for operating the door.

2. Description of the Related Art

One form of prior art safety device for an upwardly acting door is disclosed in U.S. Pat. No. 2,791,654 which issued on May 7, 1957 and is entitled "Combined Safe Edge and Sight Guard for Elevator Doors". In U.S. Pat. No. 2,791,654 a combined safety edge and sight guard is provided for elevator doors using a microswitch which is closed when a cushioned edge is depressed by an interfering object.

Another prior art device is disclosed in U.S. Pat. No. 3,001,038 entitled "Overhead Closure Safety Halting System and Actuator Therefor" which issued on Sep. 19, 1961 and discloses an overhead closure safety halting system utilizing an actuating bar mounted on the leading edge of a garage door to close a switch when interference occurs.

In the prior art U.S. Pat. No. 4,115,952 entitled "Safety Door Edge" which issued on Sep. 26, 1978, there is disclosed a safety door edge that employs a flexible channel along the door edge containing a pair of contacts which come together when the channel is compressed.

U.S. Pat. No. 4,953,608 entitled "Safety Device, Particularly for Roll-Up Doors" which issued on Sep. 4, 1990 discloses a safety device particularly intended to be used in roll-up doors to cause reversal of the door closing movements in case an obstacle obstructs the path of movement of the door. The safety device of U.S. Pat. No. 4,953,608 includes a pair of photoelectric cells which are arranged at a certain distance from the closing edge of the door leaf in alignment with the door leaf on a support arm which is displaceable in the direction of closing of the door.

It is noted that none of the prior art discloses an upwardly moveable door safety system including a sensing device to sense when the overhead door is no longer level, whether it is in a vertical position or in the horizontal position. Furthermore, the prior art safety systems do not include a system having a sensing means which detects an obstacle in the door's path that causes the panels of the door to be misaligned horizontally, thereby causing the door to possibly jam and, if not corrected, causing structural damage to the door.

Accordingly, it is an object of the subject invention to overcome the shortcomings of the prior art safety systems and provide a safety system for an upwardly moving door including a sensing device that detects when a motor-operated door's panels are not horizontally aligned, whether the door is in the vertical or in the horizontal position.

It is a further object of the subject invention to provide a safety system including a sensing device that is simple and inexpensive to manufacture and is readily incorporated into the control system of an existing electrically operated automatic door.

SUMMARY OF THE INVENTION

The new and improved sensing device of the subject invention is formed of an impact resistant elongated box that is designed to be attached in a horizontal orientation to the door frame. The elongated box includes a longitudinally extending, generally cylindrical pathway therein having an enlarged diameter at its central portion, and with the pathway tapering in opposite directions from the enlarged diameter central portion to the opposite or distal ends thereof.

Disposed at each of the opposite ends of the tapered cylindrical passageway is a recess containing electrical contact points from which extend electrical lines to the control circuitry of the safety system for the upwardly moveable door. An electrically conductive ball bearing is disposed in the longitudinally extending tapered passageway. Accordingly, when the door panel to which the subject sensing means is attached is in a generally horizontal position, whether the door is in the vertical or horizontal position of operation, the ball bearing will rest in the dwell or enlarged diameter portion of the passageway. However, should the door engage an obstruction such that the door panel is distorted and no longer horizontal, the ball bearing will roll to the lower end of the sensing device and into a recess, thereby establishing electrical contact with the contact pins. This, in turn, will trigger the control system to immediately stop the operation of the door, thereby preventing any further damage to the door structure.

Since the elongated cylindrical tapered passageway within the subject sensing device is circular in cross section along its entire length, the subject sensing device is fully operational during all positions of the door panel to which it is attached. That is, the subject sensing device is fully operational when the door panel is in the horizontal position, the vertical position, or any intermediate angular position.

In the operation of the safety system of the subject invention, when the door is no longer aligned to the horizontal or vertical plane, the sensing device of the subject invention changes from a normally open electrical state to a closed electrical state at which time it interrupts the control circuitry associated with the door mechanism and the actuating motor for the door is automatically stopped.

At such time, the door will remain at the position at which the interruption occurred and will not function until the situation causing the activation of the subject sensing device is corrected and, after that time, the safety system may be reset to its normal open state.

It has been determined that for a door unit having a width in the range of 8 feet to 12 feet that the subject sensor should be constructed to be activated when there is more than a 1 degree deviation from the horizontal. In other words, for a door width of 8 feet, a deviation of one side of the door from the horizontal of about 1 inch will cause the sensor to be activated.

For a door of approximately twenty (20) feet, a sensor should be installed on each of the opposite ends of the width of the door, and the angle of activation should be in the range of 1 degree to 1½ degrees.

DETAILED DESCRIPTION OF THE DRAWINGS

DESCRIPTION OF THE PREFERRED EMBODIMENT

Figure 1:
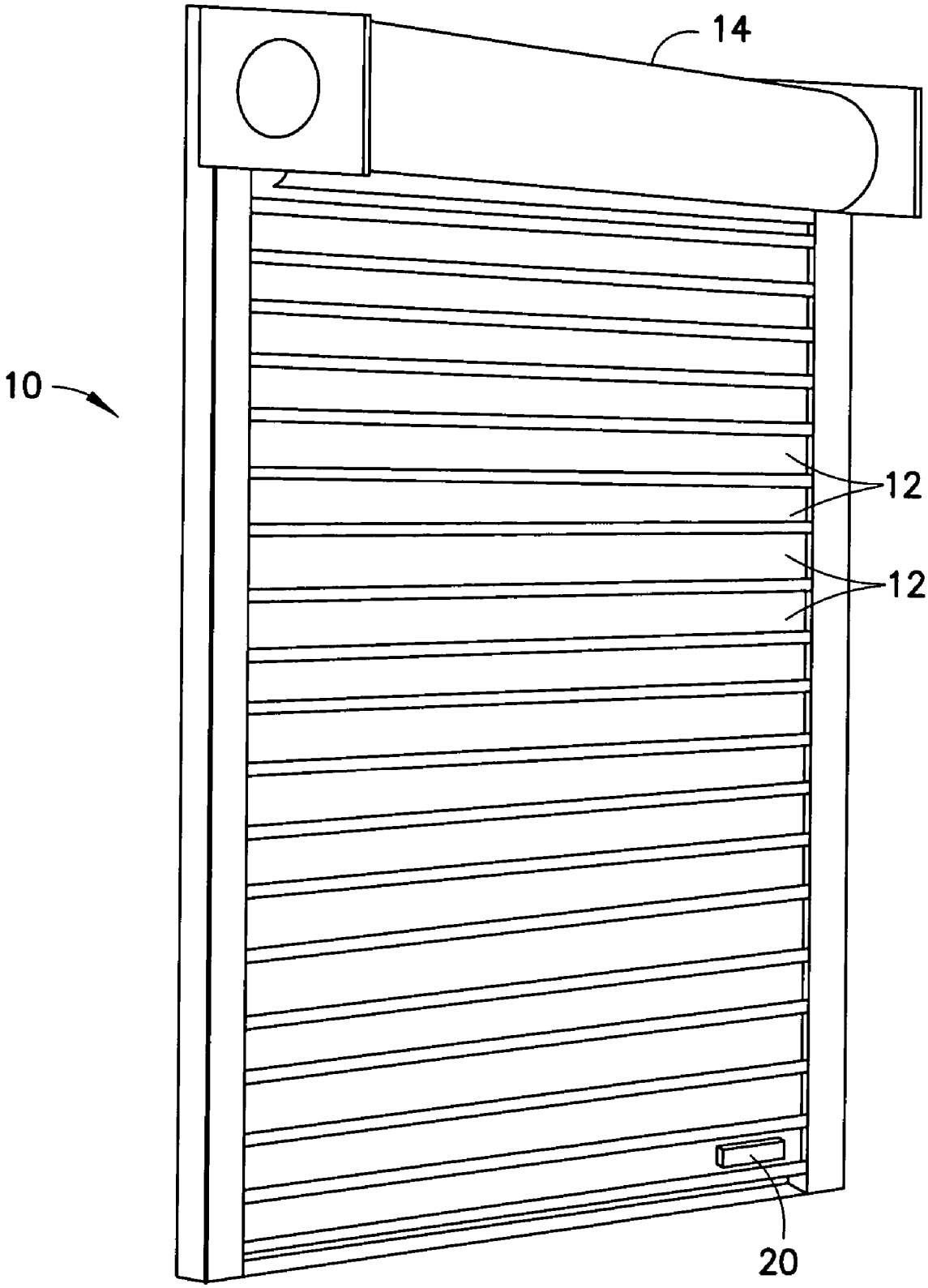
FIG. 1 is a perspective view of a roll-up type door to which a sensing device of the subject safety system is mounted.

Turning of FIG. 1, there is illustrated a commercial type rolling steel door 10, which includes a plurality of horizontally extending slats 12 which may be retracted and stored in the overhead counterbalance assembly, designated by the numeral 14. The sensor device of the subject invention is designated by the numeral 20 and is mounted in a horizontal disposition on a lower slat 12 of the door 10. Extending from the sensor device 20 the electrical lead lines (not shown) which connect to the electrical control circuit panel (not shown) for controlling movement of the door 10 between the closed position, as shown in FIG. 1, to the open position wherein the slats 12 are stored within the counterbalance assembly 14.

Figure 2:
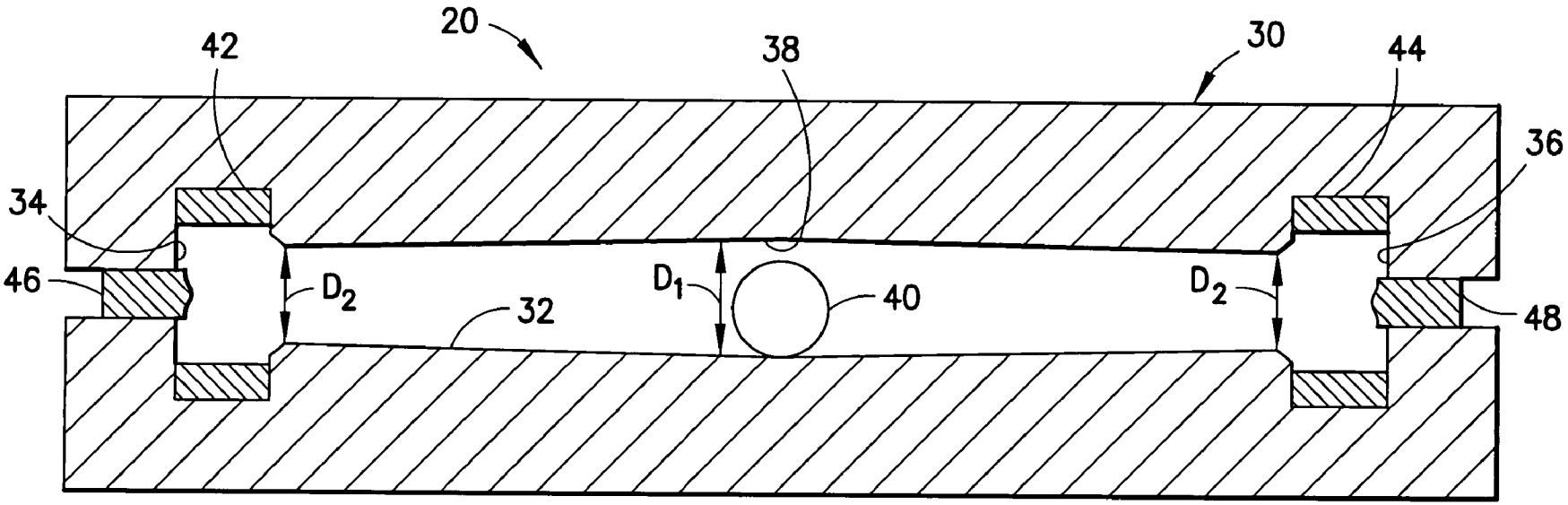
FIG. 2 is a schematic view, in cross-section, illustrating the principal of operation of the subject sensor of the subject invention.

FIG. 2 schematically illustrates the principal of operation of the sensor device 20 of the subject invention. The sensing device 20 is preferably formed from a molded housing 30 so is to be impact resistant and waterproof, and includes an elongated, generally cylindrical pathway 32 having opposite ends which terminate in enlarged recess areas 34 and 36. Along the entire length of the cylindrical passageway 32, the cross section is circular. Intermediate the length of the cylindrical passageway 32 is an enlarged diameter portion 38 which defines a center dwell point for an electrically conductive ball bearing 40. The elongated pathway 32 tapes inwardly from the enlarged diameter portion 38 toward each of the enlarged recess areas 34 and 36. As shown, as shown in FIG. 2, diameter of the enlarged diameter portion 38 is designated by $D_1$, whereas the diameters of the pathway 32 leading to the recess areas 34 and 36 is each designated by $D_2$. The diameter $D_1$ is greater than the diameter $D_2$. Preferably, the taper of the pathway from the enlarged diameter portion to the recess areas 34 and 36 is in the range of 0° to 5°, and preferably 1° to 1.5°.

In effect, the pathway 32 extending from the dwell point or enlarged diameter portion 38 to the recess areas 34, 36 defines opposite cone-shaped pathways, with the incline angle being approximately 1°.

By virtue of this arrangement, the pathway 32 maintains the ball bearing 40 at the dwell point or enlarged diameter portion 38 when the sensing device 20 is horizontal. The cylindrical configuration of the pathway 32 ensures that the sensing device 20 will operate at any degree of rotation of the sensing device as the door 10 is moved from the horizontal to vertical positions.

At each of the recess areas 34, 36 there is provided a conductive metal ring, such as brass tubing section 42, 44, and at the center of and aligned with the longitudinal axis of the cylindrical pathway 32 is an electrically conductive center contact pin, designated by the numerals 46, 48. The center contact pins 46, 48 are spaced from and thus electrically isolated from the conductive rings 42, 44. The spacing between each conductive metal ring 42, 44 and the conductive center contact pin 46, 48 is less than the diameter of the conductive ball 40 in order for an electrical connection to be made when the housing 30 is tilted and the ball bearing spans the distance between the ring and pin.

Figure 3:
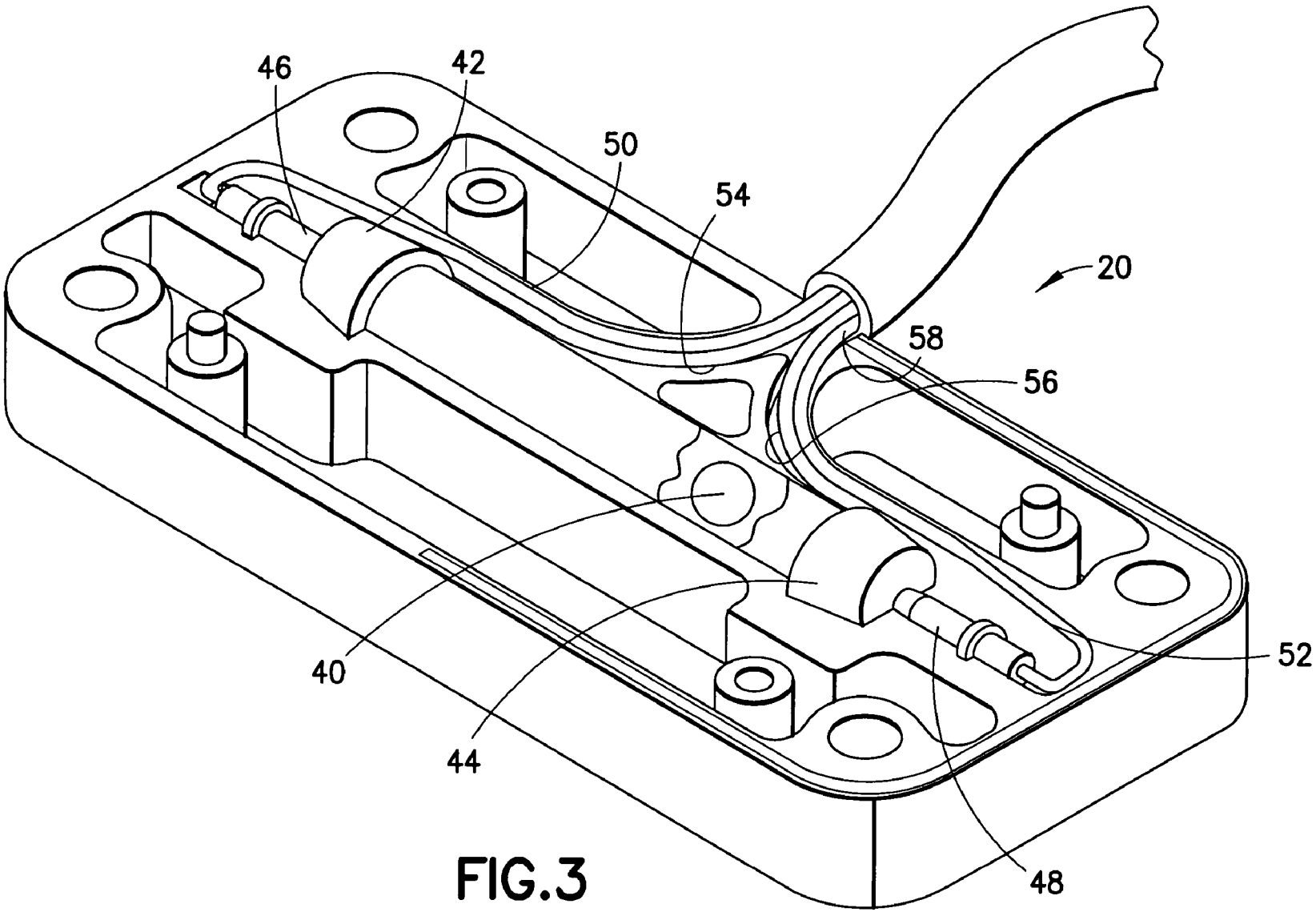
FIG. 3 is a perspective view of the main body portion of the sensing device of the subject invention, with the cover removed, and with portions of the sensing device shown in partial section to reveal the ball bearing.
Figure 4:
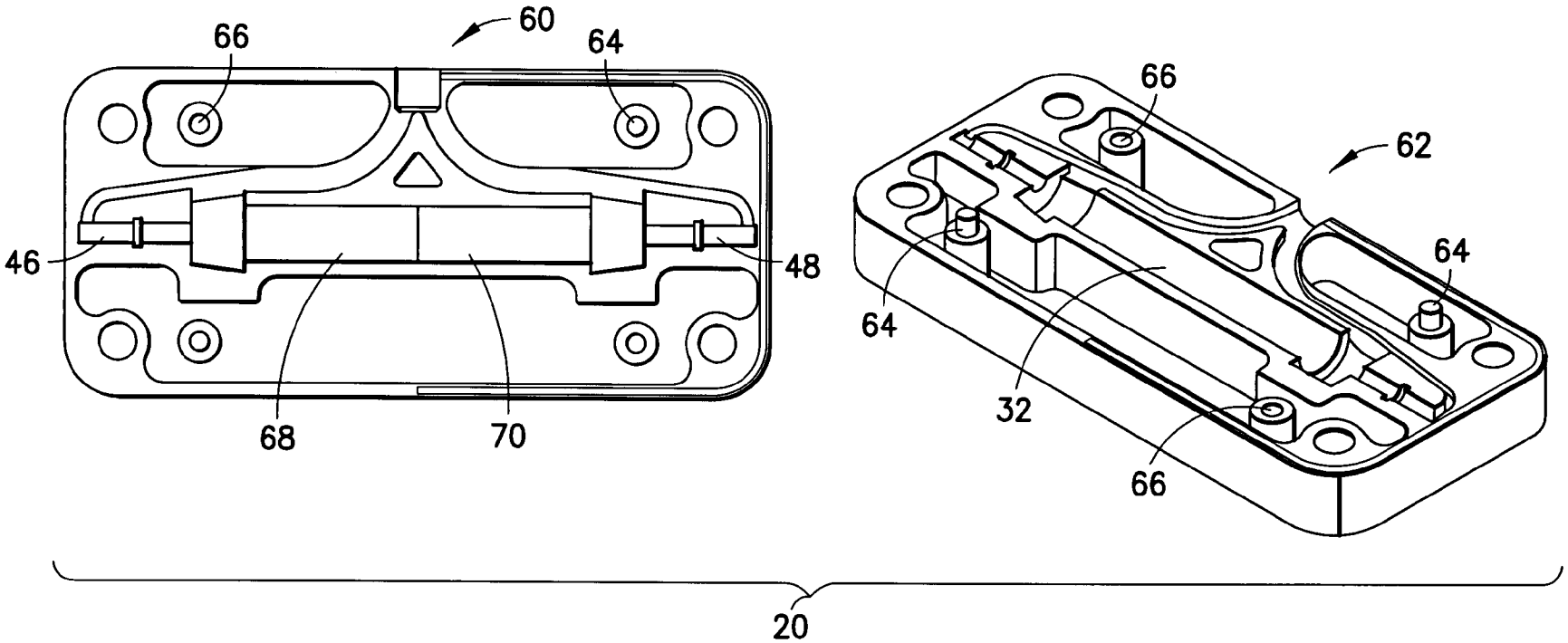
FIG. 4 is a composite view of the main body portion and cover section of the subject sensor in the disassembled state.

In FIGS. 3 and 4, elements that correspond to the elements illustrated in FIGS. 1 and 2 are designated by the same numerals.

As illustrated in FIG. 3, electrical lines 50, 52 extend from the center contact pins 46, 48 and electrical lines 54, 56 extend from the contact rings 34, 36 to the electrical control circuitry of the safety system.

FIG. 3 also illustrates the operational sensor 20 of the subject invention. The elongated housing 30 is preferably made of high impact molded plastic, and includes a side opening 58 for the passage of the electrical leads 50–56 extending from the contact pins 46, 48 and the conductive metal rings 42, 44. As shown in FIG. 3, part of the pathway 30 is sectioned so as to reveal the ball bearing 40.

FIG. 4 illustrates the main body portion 60 and the cover 62 of the housing 30. As noted above, the two sections of the housing are secured by suitable connectors (not shown), and the housing 30 includes alignment projections 64 and alignment holes 66 to maintain the main body portion 60 and the cover 62 of the sensor 20 in proper alignment.

As shown in FIG. 4, the elongated pathway may be formed by two, cone-shaped non-conductive tubes 68 and 70 which are fixed within the housing 30 and lead to the recess areas 34, 36.

The ball bearing 40 is made of an electrically conductive material. The housing 30 of the sensing device 20 is secured to the door 10 by suitable means, such as screws, adhesive, etc.

In the normal operation of the door 10, where no obstructions are encountered by the door as it is moved between the horizontal and vertical positions, the electrically conductive ball bearing 40 will remain in the dwell position of the enlarged diameter portion 38 of the sensor 10 as the door is operated.

When the door 10 engages an obstruction, the slat 12 to which the electrical sensor 20 is attached will deviate from the horizontal, thereby resulting in tilting of the elongated housing 30. Any tilting of the housing 30 in excess of the angular taper of the pathway 32 will cause the conductive ball 40 to roll to the respective recess area 34 or 36. As the conductive ball 40 enters the respective recess area, it would establish an electrical connection between the respective contact pin 46, 48 and the contact ring 42, 44. This will complete the electrical connection to the safety system and cause an immediate halt to the motion of the door 10. At this point the electrical conductive ball 40 is maintained in place in the respective recess area 32, 34 and maintains the electrical connection until such time as the obstruction is removed and the door 10 is returned to its operative made of operation.

It has been found that the angle of taper within the elongated passageway from the central dwell point 38 having a diameter $D_1$ to each opposite distal end leading to the diameter $D_2$ should be in the range of 0° to 5°, and preferably 1° or 1.5°.

It also has been found that for large commercial doors of a width greater than 12 feet, it may be necessary to use two sensors 20, one at each end of the width of the door.

It is also noted that the elongated passageway 32 is circular in cross section along its entire length. Accordingly, the subject sensor 20 is operative at all times when the door is disposed in the vertical position, the horizontal position, or at any intermediate position. More particularly, as the door is moved between a vertical position and a horizontal position, the ball bearing 40 merely rotates within the elongated pathway 32, and is maintained in the dwell position, until such time as the door is inclined so as to cause the ball bearing 40 to move in the respective direction towards a recess area 34 or 36.

As it is readily apparent, numerous modifications and changes may readily occur to those skilled in the art, and hence it is not the desire to limit the invention to the exact construction and operation shown and described, and accordingly all suitable modification and equivalents may be resorted to for falling within the scope of the invention as claimed.

What is claimed is:

1. A safety sensor for a power operated overhead door comprising:

an elongated housing made of non-conductive material and having an elongated pathway, said pathway having a circular cross-section along its length, with the midpoint of the pathway being of greater diameter than the diameters of the distal ends thereof, and with the pathway tapering inwardly from said midpoint to the distal ends thereof;

said housing having a recess portion at each distal end of the elongated pathway;

an electrical contact disposed in each said recess portion and connected to the electrical power system of the overhead door;

a ball bearing disposed in said elongated pathway, each electrical contact including a conductive ring and an electrical contact pin, said conductive ring and contact pin being spaced from each other at a distance less than the diameter of the ball bearing; and said elongated housing being mounted horizontally to the door whereby upon the door being tilted, said ball bearing will roll to the respective recess portion to establish an electrical contact for disengaging the electrical power system thereby stopping movement of the door.

2. A safety sensor for a power operated overhead door as in claim 1, wherein the taper of the pathway extending from said midpoint to each distal end thereof is in the range of 0° to 5°.

3. A safety sensor for power operated overhead door as in claim 2, wherein the taper is 1°.

4. A safety sensor for power operated overhead door as in claim 2, wherein the taper is 1.5°.

5. A safety sensor for a power operated overhead door as in claim 1, wherein the conductive ring is made of bronze.

6. A safety sensor for a power operated overhead as in claim 1, wherein the electrical contact pin is aligned with the longitudinal axis of the pathway.

7. A safety sensor for a power operated overhead door comprising:

an elongated housing made of a non-conductive material which is impact resistant and waterproof, said elongated housing having an elongated pathway, said pathway having a circular cross-section along its length, with the midpoint of the pathway being of greater distance than the diameters of the distal ends thereof, and with the pathway tapering inwardly from said midpoint to the distal ends thereof;

said housing having a recess portion at each distal end of the elongated pathway, with an electric contact disposed in each said recess portion, each said electrical contact including a conductive ring and a contact pin, said conductive ring and contact pin being spaced from each other, said contact pin and the longitudinal axis of the conductive ring being aligned with the longitudinal axis of the pathway;

a ball bearing disposed in said elongated pathway, the diameter of said ball bearing being greater than the spacing between said contact pin and the conductive ring that are disposed in each said recess portion; and said elongated housing being mounted horizontally to the door whereby, when the door is tilted, said ball bearing will roll to the respective recess portion to establish an electrical contact for disengaging the electrical power system thereby stopping movement of the door.

8. A safety sensor for a power operated overhead door as in claim 7, wherein the taper of the pathway extending from said midpoint to each distal end thereof is in the range of 0° to 5°.

9. A safety sensor for a power operated overhead door as in claim 8, wherein the taper is 1°.

10. A safety sensor for a power operated overhead door as in claim 8, wherein the taper is 1.5°.

* * * * *